United States Patent [19]

Barrois et al.

[11] Patent Number: 4,761,003

[45] Date of Patent: Aug. 2, 1988

[54] PRINTED SHEET REMOVAL ASSEMBLY

[75] Inventors: Claus D. Barrois, Marktheidenfeld; Philipp A. Dieterich, Randersacker, both of Fed. Rep. of Germany

[73] Assignee: Koenig & Bauer Aktiengesellschaft, Würzburg, Fed. Rep. of Germany

[21] Appl. No.: 79,402

[22] Filed: Jul. 30, 1987

[30] Foreign Application Priority Data

Aug. 8, 1986 [DE] Fed. Rep. of Germany ..... 3626937

[51] Int. Cl.[4] ..... B65H 29/04

[52] U.S. Cl. ..... 271/280; 271/204; 271/277; 271/294; 271/300

[58] Field of Search ..... 271/280, 292, 294, 277, 271/82, 312, 204, 206, 300; 209/903

[56] References Cited

U.S. PATENT DOCUMENTS 1,607,143 11/1926 White ..... 271/300 X 4,582,316 4/1986 Wirz ..... 271/206 X

FOREIGN PATENT DOCUMENTS 3322342 9/1984 Fed. Rep. of Germany .

3347778 12/1985 Fed. Rep. of Germany .

*Primary Examiner*—Richard A. Schacher

*Attorney, Agent, or Firm*—Jones, Tullar & Cooper

[57] ABSTRACT

A printed sheet removal assembly selectively disengages sheets from the grippers of a sheet transport by actuation of a pivotable switch lever that moves an axially slidable rotating switch shaft. A two step switch cylinder is carried by the switch shaft and has adjacent rolling surfaces. One of these rolling surfaces is cam shaped and causes a control roller to move a gripper opening segment into the path of a sheet gripper. The switch cylinder is spring loaded and returns to its switched off position once the switch lever has been released.

4 Claims, 2 Drawing Sheets

PRINTED SHEET REMOVAL ASSEMBLY

FIELD OF THE INVENTION

The present invention is directed generally to an assembly for removing printed sheets from a sheet fed rotary printing machine. More particularly, the present invention is directed to an assembly for removing selected printed sheets from a sheet fed rotary printing machine. Most specifically, the present invention is directed to an assembly for the removal of selected printed sheets from the sheet delivery of a sheet fed rotary printing machine which utilizes a chain delivery with gripper rows. The sheets removed by the sheet removal assembly are delivered to a sample sheet delivery box at the discretion of the press operator by actuation of a switch lever that causes the sheet grippers holding a selected sheet to release only that sheet. This is accomplished by sliding movement of a switch shaft which causes a camming surface to move into engagement with a control roller on the sheet grippers carried by the sheet gripper transport chain.

DESCRIPTION OF THE PRIOR ART

During the production of printed sheets on a sheet fed rotary printing machine, it is typically necessary to periodically remove one or more sample or test sheets for inspection. In this way, the quality of the products being printed may be periodically evaluated, and any necessary press changes or adjustments can be made before a large quantity of sheets are improperly printed. One way of obtaining test sheets is to stop the printing press, remove one or more sample sheets and re-start the press. As can readily be appreciated, this is not an efficient method of press operation and thus is not done in a production situation. Instead, various prior art devices are known for periodically removing one or more sample or test sheets without stopping printing operations.

One prior art device for removing a test sheet is shown in German Pat. No. 3,347,778. A sheet to be removed for inspection is carried by delayed opening gripper rows over and past a sheet deliver stack and to a suction roller. This suction roller conveys the selected sample or test sheet to a separate sheet exit. The delayed opening of the selected sheet gripper row which carries the selected sample sheet is accomplished by the pivotal movement of a gripper opening segment in the direction of sheet transport. The particular angle of pivotal movement of the gripper opening segment determines the length of delay of the sample sheet gripper row opening. This prior art assembly requires the press operator to manually select the desired angle of pivotal motion and also requires the press operator to be attentive to the rhythm of the printing press.

Another prior art printed sheet sampling assembly is shown in German Pat. No. 3,322,342. This assembly is somewhat similar to the above discussed prior art device, and the sheet to be separated from its gripper rows attached to chains is fed over and past a sheet delivery stack and to a transport roller which delivers the sample sheet or sheets separately. In this prior art device, the sheet separation assembly is equipped with two gripper opening segments which are positioned one behind the other in the direction of sheet transport. A first of the gripper opening devices is pivotable and is spring loaded. The spring force attempts to pivot the gripper opening segment out of its gripper opening positioned but is prevented from doing so by a stop pawl. When this stop pawl is released, this gripper opening segment, which is positioned on a lever, pivots out to an inoperative position. A roller that is rotatably supported on, and carried by one end of this pivoted lever positions itself adjacent to a cam disc connected to a toothed drive wheel for the gripper chain, and rolls along against the circumference of the cam disc. In this pivoted position, the gripper opening segments are no longer operating so the grippers do not open over the sheet delivery stack but instead carry the printed sheets along to the second, stationary gripper opening device. This second, stationary gripper opening means functions to open the sheet grippers so that the sample sheet can be released to the transport roller which carries the selected sample sheet away. Once the sheet has passed the first, pivotable sheet gripper opening device, this segment is pushed back to its original starting position by its roller which contacts the cam disc that is formed having a surface shape to allow the lever to pivot back into its operative position and to be locked there by the stop pawl.

As with the previously discussed prior art sheet sampling apparatus, this prior device requires the attention of the press operator to the rhythm of the printing press so that he will manually operate this sheet sampling assembly in synchronization with the sheet deliver speed and timing. Additionally, in these prior art devices the press operator is required to have access to the transport area of the sheet gripper rows. This may present a safety hazard and could possibly increase the risk of press operator injury. It will thus be seen that a need exists for a printed sheet removal assembly which does not require the operator to pay particular attention to the gripper opening rhythm and which does not pose a possible operator safety hazard. The printed sheet removal assembly of the present invention provides such a device.

SUMMARY OF THE INVENTION

It is an object of the present invention to provide a printed sheet removal assembly.

Another object of the present invention is to provide a printed sheet removal assembly for a sheet fed rotary printing press.

A further object of the present invention is to provide a printed sheet removal assembly for selectively removing a printed sheet from a sheet transport means.

Yet another object of the present invention is to provide a printed sheet removal assembly for selectively removing a printed sheet from sheet grippers.

Still a further object of the present invention is to provide a printed sheet removal assembly which allows removal of a selected sheet from the sheet grippers while not requiring the operator to be attentive to the gripper opening rhythm.

Even yet another object of the present invention is to provide a printed sheet removal assembly which does not require the operator to have access to the transport area of the chain driven gripper rows.

As will be discussed in greater detail in the description of the preferred embodiment which is set forth subsequently, the printed sheet removal assembly in accordance with the present invention utilizes a switch lever to slide a switch shaft in an axial direction. As the switch shaft moves against the bias of a compression spring, a control roller which rides on an axially slidable cylindrical two step switch cylinder carried by the switch shaft is guided onto a cam shaped surface portion of the switch cylinder rolling surface. A gripper opening segment is attached to, and movable with this control roller and, as the roller rides onto the cam shaped portion, the gripper opening segment contacts a gripper control roller and opens the grippers which release a selected sheet into a delivery box.

The switch lever, which is pivoted about a pivot point to slide the axially movable switch shaft, is located a distance from the sheet gripper transport chains. This assures operator safety since the operator, in contrast to the prior art devices, does not place his hands in the area of the transport chains. The switch lever is provided with a hand grip at its free end and this lever and grip can be shaped as dictated by the press configuration to assure operator safety.

The axially slidable two step switch cylinder on which the switch roller rides has its angular position defined by an assembly of an elongated keyway and a cooperating key. This insures that the switch roller will only change the position of the gripper opening segment at the appropriate time with respect to the position of the sheet gripper transport chains. The press operator thus need not pay particular attention to the rhythm of the opening of the sheet grippers. Only when the sheet gripper control rollers are in the proper position will the gripper opening segment be moved by the two step switch cylinder and switch roller to the proper position to actuate the sheet grippers so that the selected sheet to be sampled will be released from the gripper chains and delivered to the separate sample sheet deliver box. It will thus be seen that the printed sheet delivery assembly of the present invention provide a device for selecting sample printed sheets which is a significant improvement over prior devices.

BRIEF DESCRIPTION OF THE DRAWINGS

While the novel feature of the printed sheet removal assembly of the present invention are set forth with particularity in the appended claims, a full and complete understanding of the invention may be had by referring to the detailed description of the preferred embodiment which is set forth subsequently, and as is illustrated in the accompanying drawings in which:

DESCRIPTION OF THE PREFERRED EMBODIMENT

Figure 1:
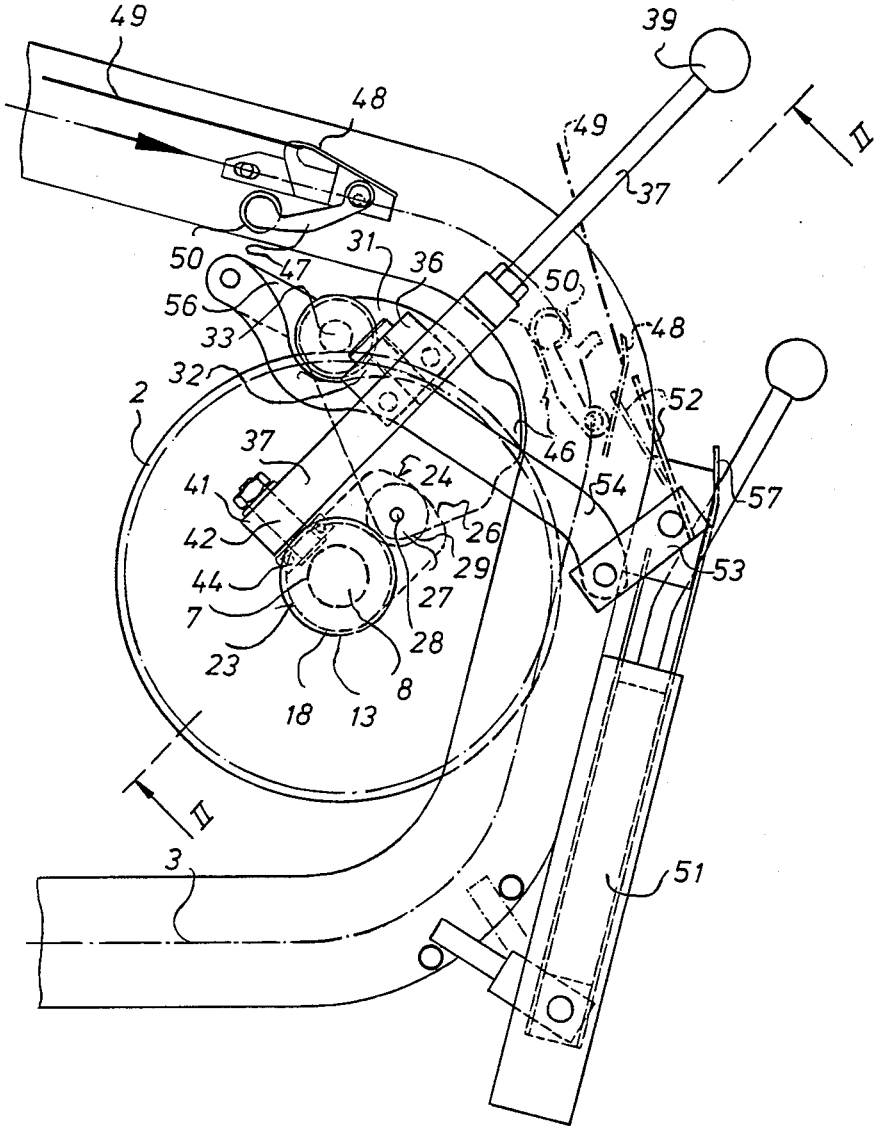
FIG. 1 is a schematic side elevation view of the sheet removal assembly of the present invention in place in a chain delivery of a sheet fed rotary printing machine.
Figure 2:
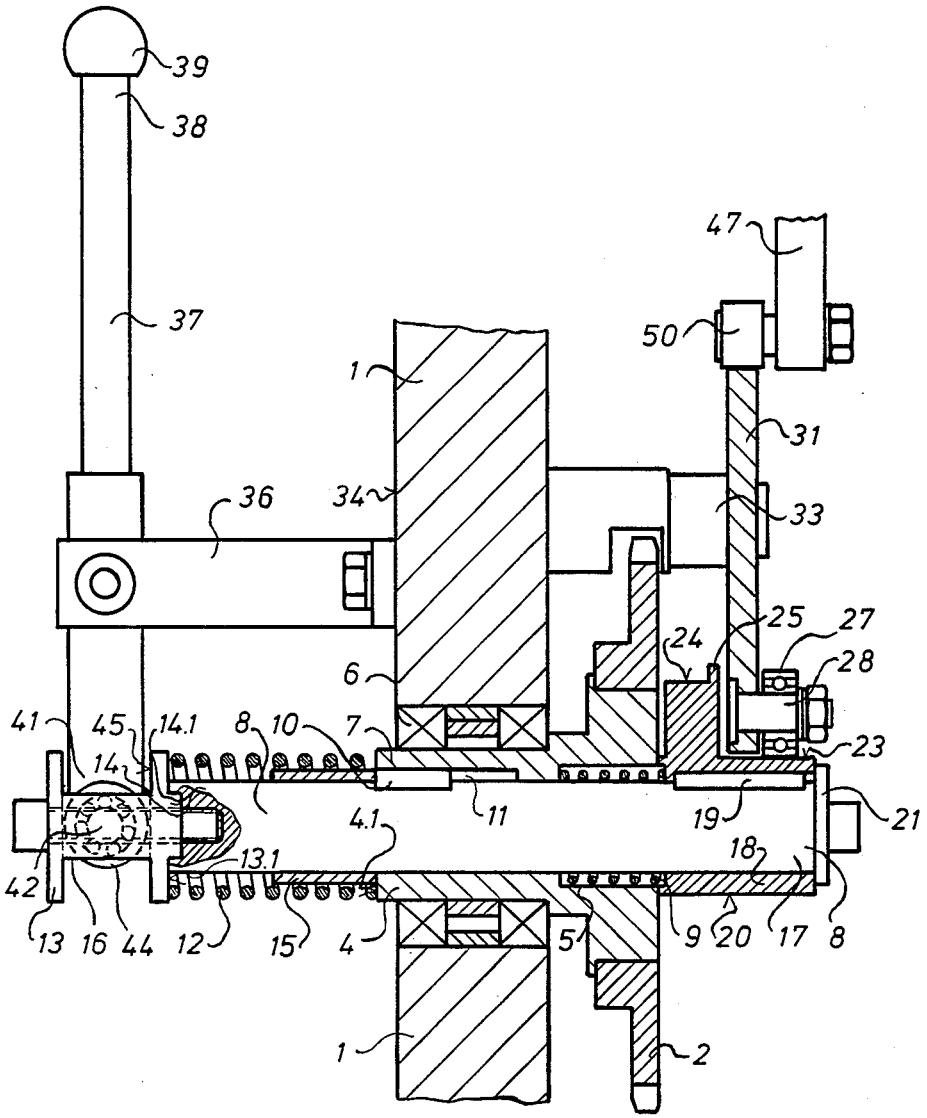
FIG. 2 is a cross-sectional view of the sheet removal device of the present invention and taken along line II—II of FIG. 1 with the gripper chains removed for clarity.

Referring initially to FIG. 2, there may be seen generally at 1 a portion of a side wall of a sheet delivery mechanism of a sheet fed rotary machine. A chain wheel 2 for a gripper transport chain 3, as may be seen in FIG. 1, is rotatably supported in side wall 1 by placement of its hub portion 4 in a roller bearing assembly 6. Chain wheel hub 4 has a central, axial bore 7 which, as may be seen in FIG. 2, has an enlarged diameter section 5 that is formed in the right side of hub bore 7. An axially slidable switch shaft 8 is supported in chain wheel hub bore 7 and is slidable in an axial direction, but is prevented from rotating in hub bore 7 by a switch shaft key 10 that is slidable axially in chain wheel hub keyway 11. This keyway 11 has a length sufficient to allow axial shifting of key 10 with movement of switch shaft 8.

A compression spring 9 is carried by slidable switch shaft 8 and is positioned within the enlarged bore portion 5 of chain wheel hub bore 7. The left end of compression spring 9 abuts the end wall formed at the termination of enlarged hub bore 5, while the right end of compression spring 9 engages an end wall of a two step switch cylinder, generally at 18, which is secured to the right end of axially slidable switch shaft 8.

A second, larger compression spring 12 is positioned about the left end of slidable switch shaft 8. As may also be seen in FIG. 2, the right end of larger compression spring 12 abuts the left end face 4.1 of chain wheel hub 4. The left end of larger compression spring 12 contacts an outer surface of an inner face 13.1 of a gate-type gear shift 13. This gate-type gear shift 13 is securely attached to the front face 14.1 of a left or first end portion 14 of slidable switch shaft 8 and has a central, reduced circumference, switch slot 16.

As alluded to previously, the two step switch cylinder 18 is carried by the right or second end 17 of axially slidable switch shaft 8. Switch cylinder 18 is prevented from rotation on switch shaft 8 by the cooperation of a switch cylinder key 19 which is received in a cooperating switch cylinder keyway. This keyway is sufficiently long with respect to switch cylinder key 19 to allow switch cylinder 18 to be axially slidable with respect to right end 18 of switch shaft 8 against the force exerted by smaller compression spring 9. A limit disk or washer 21 is attached to an end face of right end 17 of switch shaft 8 and prevents two step switch cylinder 18 from being slid off the end of switch shaft 8 by smaller compression spring 9.

Two step switch cylinder 18 is formed having two axially adjacent circumferential rolling surfaces, 23 and 24, as may be seen in FIG. 2. First or outer rolling surfaces 23 is cylindrical, while second or inner rolling surface 24 is cam shaped, as may be seen in phantom line in FIG. 1. Cam shaped inner rolling surface 24 has a switch cam surface portion 26 and this is bounded by a raised stop collar 25 which separates this portion of second rolling surface 24 from first rolling surface 23.

A control roller 27, which is rotatably attached to a gripper opening member 31 by a suitable fastening means such as a bolt 28, rides on the surface of two step switch cylinder 18, as may be seen in both FIGS. 1 and 2. Roller 27, while it is riding on inner, camming rolling surface 24 of switch cylinder 20 is prevented from falling back onto cylindrical outer rolling surface 23 of switch cylinder 18 by raised stop collar 25. As may be seen most clearly in FIG. 1, control roller 27 is secured in a first corner portion 29 of gripper opener 31 which is somewhat triangular in shape. An apex portion 32 of gripper opener 31 is pivotably supported on a journal 33 which is secured to side wall 1 of the sheet delivery mechanism. Thus, as roller 27 runs on the switch camming surface 24 of two step switch cylinder 18, the gripper opener 31 is caused to pivot about its apex 32 on journal 33.

A horizontally extending holder 30 is secured to a side 34 of side wall 1 generally opposite to, and at approximately the same height as journal 33. This holder 36 supports a pivotable switch lever 37 that is pivotably secured, generally at its midpoint, to holder 36, as is most clearly shown in FIG. 2. Switch lever 37 is provided with a hand grip 39 at its upper end 38 and at its lower end 41 it carries a bolt 42 which passes through the switch lever, as may be seen in FIG. 1. As switch roller 44 is rotatably supported on switch lever 37 at its lower end 41 by bolt 42. This switch roller 44 is positioned in the switch slot portion 16 of the gate type gear shift 13 so that movement of upper end 38 of switch lever 37 in a first direction will result in a movement of gear shift 13 and hence switch shaft 8 in an opposite direction.

The operation of the printed sheet removal assembly of the present invention will now be discussed. When it is desired to extract one or more sample sheets from the gripper chain sheet transport assembly, the operator grasps hand grip 39 and moves this upper portion of switch lever 37 away from side frame 1. The switch roller 44 carried at the lower end of switch lever 37 is brought into contact with an inner side 45 of switch slot 16 on gear shift 13 and causes axially slidable switch shaft 8 to move to the right against larger compression spring 12 until the gear shift 13 contacts an end of a distance or spacer sleeve 15 which is carried by switch shaft 8. A switch shaft 8 moves axially to the right, it carries with it limit disk or washer 21 and switch cylinder key 19. The two step switch cylinder 18 also will now be biased to the right by smaller compression spring 9. However, movement of switch cylinder 18 to the right is only possible in the position wherein control roller 27 is on a portion 20 of the surface of switch cylinder 18 where both first and second switch cylinder rolling surface 23 and 24, respectively have a common radius. As the switch cylinder 18 rotates with slidable switch shaft 8 while the are both caused rotate by chain wheel 2, once the control roller 27 is rolling in common radius surface 20, the switch cylinder may then move to the right through application of the force of smaller compression spring 9. This causes switch cylinder 18 to move to a switched in position so that control roller 27 will now ride on inner rolling surface 24 and onto the switch cam surface portion 26 thereof. As discussed previously, raised stop collar 25 prevents control roller 27 from drifting back onto outer rolling surface 23.

With control roller 27 running on switch camming surface 26 the gripper opening member 31 will pivot upwardly about its apex 32 so that an integral cam portions 46 of gripper opening member 31, as may be best seen in FIG. 1 will be caused to move generally vertically upwardly so that it becomes positioned in the path of a gripper control roller 50 which is rotatably secured to a gripper opening lever 47. A sheet 49 to be removed from grippers 48 is released as gripper control roller 50 actuates gripper opening lever 47. This now released sheet 49 is deposited in a delivery box 51 which is attached to the side frame 1, as may be seen in FIG. 1. Delivery box 51 is provided with a sheet guide finger 52 that can be moved into the sheet movement path. As may also be seen in FIG. 1, this movement of sheet guide finger 52 is accomplished through the cooperation of a first connecting rod 53 which is secured at a first end to sheet guide finger 52 and at a second end to a first end of a second connecting rod 54. A second end of second connection rod 54 is, in turn, connected to a lever arm 56 carried by gripper opener 31. Thus as the gripper opener 31 is moved upwardly by control roller 27 to bring camming surface 46 into the path of gripper control roller 50 thus moving gripper opening lever 47 upwardly to release a sheet 49 to be sampled from sheet grippers 48 carried by sheet transport gripper chains 3, the sheet guide finger 52 moves into the path of sheet travel so that the now released sheet 49 will be delivered to delivery box 51 by sliding between sheet guide finger 52 and a right hand side wall 57 of delivery box 51.

If only one sheet 49 is to be sampled, the operator may release hand grip 39 of switch lever 37 once the control roller 27 has moved onto the inner rolling surface 24 of two step switch cylinder 18. The operator can then attend to other duties since after approximately one half a rotation of switch cylinder 18, the control roller 27 will again return to common radius portion 20 of the rolling surface of switch cylinder 18. Since raised stop collar 25 is no longer engaging control roller 27, the greater force of larger compression spring 12 will overcome the smaller force of smaller compression spring 9 thereby moving switch shaft 8 back to its original position and thereby also moving switch cylinder 18 back to its position as depicted in FIG. 1 so that control roller 27 will again run on outer rolling surface 23 which has a uniform radius. Thus no more sheets will be removed from the sheet grippers 48 carried by sheet transport chains 3. Alternatively, if it is desired that more than one sample sheet be removed, the operator need only continue to hold switch lever 37 in its actuated position. This will keep control roller 27 on inner cam shaped rolling surface 24 of two step switch cylinder 18 so that sheets 49 will continue to be released from grippers 48 and delivered to delivery box 51. Once switch lever 37 is released, sheet sampling or removal will stop, as was discussed above.

It will thus be seen that the printed sheet removal assembly in accordance with the present invention operates to quickly and efficiently remove a selected sample sheet or sheets from an ongoing sheet transport device in a manner that does not require the operator to pay particular attention to the gripper opening rhythm and which also keeps the hands of the operator away from the sheet transport chains. This printed sheet removal assembly thus constitutes a substantial improvement over prior art devices and simplifies the sheet sample removal procedure.

While a preferred embodiment of a printed sheet removal assembly in accordance with the present invention has been fully and completely described hereinabove, it will be apparent to one of skill in the art that a number of changes in, for example, the type of sheet grippers and their spacing, the type of printing press, the types of bearings and rollers used and the like could be made without departing from the true spirit and scope of the present invention which is accordingly to be limited only by the following claims.

What is claimed is:

1. A printed sheet removal assembly for the selective removal of one or more sheets from a sheet delivery of a sheet fed rotary printing machine, the sheet delivery including sheet grippers having cam controller gripper opening means and gripper transport chains, said printed sheet removal assembly comprising:

a drive wheel rotatably secured in a side frame of the sheet delivery and being drivable by the gripper transport chain, said drive wheel including a central bore;

an axially slidable switch shaft carried in said wheel bore and being rotatable with said drive wheel;

a gate type gear shift secured to a first end of said switch shaft and a limit disk secured to a second end of said switch shaft;

a two stepped axially slidable spring biased switch cylinder carried on said switch shaft and rotatable therewith, said switch cylinder being positioned intermediate said drive wheel and said limit disk;

a compression spring carried on said axially shiftable switch shaft intermediate said gate-type gear shift and said drive wheel; and a switch lever pivotably attached to said side frame and engaging said gate-type gear shift, said switch cylinder being in rolling contact with a control roller carried by a pivotably supported gripper opening means whereby axial movement of said switch shaft in response to pivotal movement of said switch lever will operate said gripper opening means to remove a sheet from the sheet delivery.

2. The printed sheet removal assembly of claim 1 further including a sheet delivery box positioned to receive the selectively removed sheet, said delivery box including a pivotable sheet guide connected to said gripper opening means by at least one connecting rod.

3. The sheet removal assembly of claim 1 wherein said switch cylinder includes first and second control roller contacting roller surfaces.

4. The sheet removal assembly of claim 1 wherein said switch lever is pivotably attached to said side frame by a generally horizontal holder.

* * * * *